United States Patent [19]

Rowe

[11] Patent Number: 4,654,858

[45] Date of Patent: Mar. 31, 1987

[54] COLD HEARTH MELTING CONFIGURATION AND METHOD

[75] Inventor: Raymond G. Rowe, Schenectady, N.Y.

[73] Assignee: General Electric Company, Schenectady, N.Y.

[21] Appl. No.: 725,263

[22] Filed: Apr. 19, 1985

[51] Int. Cl.[4] ..... H05B 7/20; F27D 3/14

[52] U.S. Cl. ..... 373/72; 222/591; 266/271; 266/236; 373/83

[58] Field of Search ..... 373/45, 67, 72, 79, 373/83, 115, 142; 432/217, 262, 263; 222/54, 590, 591, 592; 266/271, 236

[56] References Cited

U.S. PATENT DOCUMENTS

| | | | |
|---|---|---|---|
| 2,871,533 | 2/1959 | Swainson | 373/72 |
| 3,484,840 | 12/1969 | Spoth et al. | 373/142 |
| 3,734,480 | 5/1973 | Zanis et al. | 266/39 |
| 3,994,346 | 11/1976 | Brown | 164/361 |
| 4,471,831 | 9/1984 | Ray | 164/508 |

FOREIGN PATENT DOCUMENTS 55827 7/1982 European Pat. Off. .

OTHER PUBLICATIONS

D. Eylon, F. H. Froes, R. W. Gardiner, "Developments in Titanium Alloy Casting Technology", Journal of Metals, Feb. 1983.

C. Liesner, "Titanium Investment Casting–Production, Properties and Applications", Titanium Science and Technology, vol. 1, 1984.

*Primary Examiner*—Roy N. Envall, Jr.

*Attorney, Agent, or Firm*—Paul E. Rochford; James C. Davis, Jr.; Paul R. Webb, II

[57] ABSTRACT

A cold hearth melting system has confining side wall area made of high thermal conductivity material and has as its bottom a diaphragm containing an orifice through which metal melted in the cold hearth is discharged. The diaphragm is made, at least in the central portion thereof containing the orifice, of material selected from the group consisting of tungsten, an alloy containing tungsten and having a melting point of at least about 3000° C., cemented tungsten carbide and tantalum carbide.

15 Claims, 1 Drawing Figure

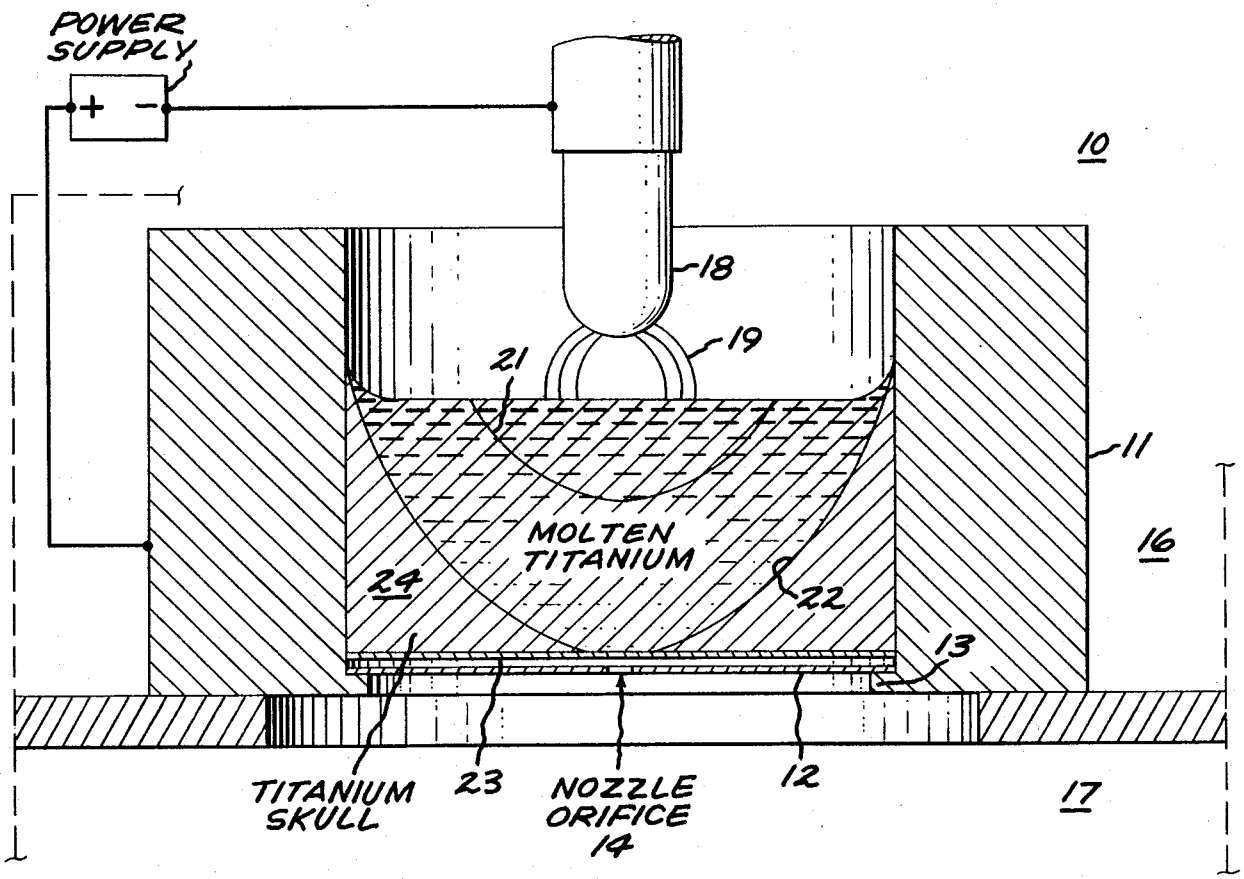
10
11
16
17
13
12
22
18
19
MOLTEN TITANIUM
NOZZLE ORIFICE 14
21
23
24
TITANIUM SKULL
POWER SUPPLY
-
+

COLD HEARTH MELTING CONFIGURATION AND METHOD

BACKGROUND OF THE INVENTION

This invention addresses problems encountered in the bottom pouring of liquid titanium (or titanium alloys).

The high level of chemical reactivity of liquid titanium or liquid titanium alloys leads to chemical reaction between such liquid and all oxide, oxysulfide, sulfide, boride or other compound ceramics. Further, all metals having a melting point higher than titanium will dissolve in liquid titanium. In short, there is no known inert containment vessel material other than titanium itself to hold molten titanium or titanium alloys. In keeping with this limitation, titanium and titanium alloys are melted by a technique called cold hearth or skull, melting.

In this technique, pieces of solid titanium are placed in a cooled metal hearth, usually made of copper, and melted in an inert atmosphere using a very intense heat source, such as an arc or plasma. During the melting process a molten pool will form initially on the interior and top surface of the charge of metal while the titanium adjacent the confining wall of the copper hearth remains solid. The "skull" of solid titanium, which develops, contains the liquid titanium metal free of contamination. The technique is used in conjunction with a consumable titanium or titanium alloy electrode for virtually all titanium primary melting and casting at the present time.

In the preparing of titanium castings, melting is generally accomplished by consumable arc melting and liquid metal so generated is poured over the lip of a skull crucible into a mold. Inherent in the act of pouring over a lip is the characteristic that a thin liquid cross section is maintained at the lip. Heat loss from the liquid as it passes over the lip will reduce the superheat of the liquid metal typically leading to the formation of a solid-liquid mixture rather than the desired liquid. Although over-the-lip pouring can be tolerated in the preparation of castings, in those applications in which a lower liquid flow rate, or at the least, a steady liquid flow rate is required, (e.g. rapid solidification) the only promise for a variable solution appears to lie in bottom pouring from a cold hearth melting system through a nozzle.

The major drawbacks of cold hearth melting and bottom pouring of reactive metals are (a) the problem of melt freeze-off in the nozzle and (b) erosion of the nozzle material by the liquid metal.

Systems have been described in the literature utilizing cold hearth arc melting in a thermally conductive hearth with bottom-ejection of the liquid metal through a nozzle insert. The nozzle material typically employed has been copper or brass, which are considered good thermal conducting materials. Graphite has also been mentioned as a nozzle material. Nozzles made of thermally insulating material also have been suggested for such a system. None of the attempts described to date have been successful in providing the requisite control of liquid flow rate and/or minimal erosion and/or minimum melt contamination.

It has, therefore, been an object of this invention to discover a nozzle material having adequate resistance to erosion and a cold hearth and nozzle configuration enabling the successful bottom pouring of liquid titanium and titanium alloys.

The term "effective diameter" as used herein is the diameter of the circle that can be inscribed in the particular planar shape (e.g. a square) in question.

"High" thermal conductivity implies a value in excess of about 80 watts/meter °C. at 700° C.

DESCRIPTION OF THE INVENTION

A test was devised to determine the resistance of various materials to erosion by liquid titanium. The test consisted of melting a small quantity of commercially pure titanium in a copper hearth by the use of tungsten non-consumable arc melting in which the titanium skull-liquid interface was able to penetrate to the bottom of the hearth and interact with a thin stopper disposed over the test nozzle. The function of the stopper was to prevent premature entry of molten titanium into the nozzle orifice. Rupture, or dissolution, of the stopper permitted immediate flow of the accumulated superheated liquid metal. At the point of ejection, the stopper melted, or dissolved, and the molten titanium was ejected under the greater pressure exerted by inert gas under pressure above the liquid metal.

It was in this way that the excellent resistance (relative to a number of ceramic and metallic materials) of tungsten and certain tungsten alloys to erosion by flowing liquid titanium was discovered. Alloys containing tungsten suitable for this application are those having a melting point at least as high as about 3000° C. Interestingly, it was found that refractory materials, which may provide limited resistance to attack by liquid titanium when the liquid metal is contained as a static pool in a crucible, do not necessarily exhibit the same resistance, when exposed to rapidly flowing liquid titanium. Thus, for example, molybdenum did not emerge as a viable nozzle material.

The success of this invention has depended not only on discovering the excellent resistance to erosion by flowing liquid titanium of tungsten (and tungsten alloys), but also on realizing the necessity for establishing a thermal profile such that during the pour the region around the orifice is at virtually the same temperature as the temperature of the liquid metal traversing the orifice. To achieve this end it was decided to substitute for the conventional simple nozzle a diaphragm nozzle.

Thus, this invention employs a diaphragm nozzle in which at least the center portion thereof (wherein the orifice is located) is constructed of tungsten (or tungsten alloys). Whereas a simple nozzle will typically have a ratio of outer nozzle diameter to nozzle length equal to about 1:1, for the diaphragm nozzle of this invention the ratio of the outside effective diameter of the diaphragm to the diaphragm thickness will be equal to, or greater than, about 10:1 with a minimum outside diameter of about 1.5 inch. Further, the ratio of outside effective diameter to orifice diameter will be equal to, or greater than, about 6:1.

In addition to the criticality of nozzle material and nozzle construction, it was also found necessary in conduct of the process to maintain a minimum depth of the liquefied metal over the nozzle to avoid exposure of the nozzle to direct, or close, contact with the intense heat source, e.g. arc or plasma, being used to effectuate the melting.

A particularly important characteristic of the mode of tungsten erosion is that to the extent that erosion occurs, it appears to be by dissolution and individual tungsten grain fall-out, rather than by the removal of large particles of tungsten from the nozzle.

The nozzle aperture should have a diameter in the range of from about 0.020 inch to about 0.75 inch. In this size range, it is, therefore, easy to select a nozzle diameter (e.g. 0.030 to 0.100 inch) applicable to rapidly solidifying titanium or titanium alloys, or a somewhat larger nozzle diameter for gas atomization. Rapid solidification requires that the nozzle orifice maintain a reasonably constant dimension during the pour. This criterion applies because of the particular need to control the liquid flow rate.

BRIEF DESCRIPTION OF THE DRAWING

The features of this invention believed to be novel and unobvious over the prior art are set forth with particularity in the appended claims. The invention itself, however, as to the organization, method of operation and objects and advantages thereof, may best be understood by reference to the preceding and to the following description taken in conjunction with the accompanying drawing wherein is shown a schematic view in cross-section of the cold hearth-nozzle configuration of this invention disposed in a pressurized upper chamber with the nozzle in flow communication with a pressurized lower chamber.

METHOD AND PROCESS OF MAKING AND USING THE INVENTION

The test briefly referred to hereinabove for evaluating the resistance of various materials to erosion by flowing liquid titanium under actual nozzle operating conditions was adjudged to be essential in the making of this invention. In the test procedure used, a titanium charge (typically 100 grams) was melted in a cold hearth using an arc with the current applied to the electrode ranging to a value as high as 1800 amperes at of 25–35 volts. With this power input, the titanium skull-liquid interface was able to penetrate to the bottom of the hearth and interact with the stopper (either metallic or non-metallic) disposed over the simple nozzle configuration embodying the particular material being tested.

Unsuccessful nozzle material tests conducted on alumina, copper, boron nitride, and various combinations of these materials appeared to establish that a beneficial effect was obtained when a thermal insulating material was used as a stopper. For each of the nozzle test materials listed in TABLE I, the nozzle test material was initially separated from the molten titanium by a dissolvable ceramic ($Al_2O_3$) plate about 0.020–0.040 inch thick as the stopper (i.e. to prevent premature flow and freeze-off of the liquid titanium metal in the nozzle orifice). In order to protect the ceramic disc from thermal shock cracking, it in turn was covered with a plate of molybdenum 0.020 inch thick. When liquid titanium contacts the molybdenum plate, the plate is dissolved, allowing the ceramic stopper directly below to dissolve and initiate flow. In those instances in which nozzles made up of multiple layers were employed, the materials are identified in the table with the upper nozzle layer first, the next lower layer of the nozzle below it, and so forth.

TABLE I

| Test No. | Nozzle Material | Thickness (inch) | Hole Size (inch) | Result |
|---|---|---|---|---|
| 1 | $Al_2O_3$ | .036 | .080 | Cast 54 gms. Alumina |
| | Copper | .063 | .125 | eroded badly. |

TABLE I-continued

| Test No. | Nozzle Material | Thickness (inch) | Hole Size (inch) | Result |
|---|---|---|---|---|
| 2 | $Al_2O_3$ | .108 | .080 | Cast 35 gms. $Al_2O_3$ |
| | Copper | .063 | 0.18 | eroded to 3/16 dia. |
| 3 | Copper | .125 | .089 | Copper erosion minimal. 40.6 gms. cast. |
| 4 | $Al_2O_3$ | .017 | .089 | Ejected only 15 gms. |
| | Copper | .125 | .089 | |
| 5 | Lucalox ® $Al_2O_3$ | .188 | .060 | Ejected well - $Al_2O_3$ |
| | Copper | .031 | .089 | eroded badly. |
| 6 | Boron nitride | .145 | .090 | Ejected well - BN |
| | Tungsten | .020 | .080 | eroded, but not tungsten. |
| 7 | Sapphire | .013 | .060 | Ejected - BN eroded, |
| | BN | .189 | .090 | but not tungsten. |
| | Tungsten | .020 | .080 | |
| 8 | $Y_2O_3.Y_2S_3$ | .223 | .060 | Ceramic dissolved - |
| | Tungsten | .020 | .075 | tungsten not eroded. |
| 9 | 50 w/o $Y_2O_3$.50 w/o W | .187 | .060 | $Y_2O_3$.W (50 w/o) eroded, but not tungsten. |
| | Tungsten | .020 | .080 | |
| 10 | $Ce_2O_2S$ | .250 | .067 | Ceramic eroded, but |
| | Tungsten | .020 | .077 | not tungsten. |
| 11 | 50 w/o $Y_2O_3$.50 w/o W | .187 | .058 | Ceramic eroded, but not tungsten. |
| | Tungsten | | | |
| 12 | Tungsten | .020 | .078 | No erosion - 137 gm. charge: 57 gm. ejected. |
| 13 | $Y_2O_3$ | .246 | .063 | $Y_2O_3$ badly eroded, |
| | Tungsten | .020 | .077 | but not tungsten. |
| 14 | Sapphire | .013 | .068 | Sapphire dissolved - |
| | Tungsten | .020 | .090 | tungsten not eroded. 70 gms of 127 gm. charge was ejected. |
| 15 | Sapphire | .013 | .086 | Double charge of Test |
| | Tungsten | .020 | .090 | 14 - no tungsten erosion. |

In certain of the tests the molten titanium froze off in the nozzle without any ejection. These constructions and comments thereon are set forth in TABLE II.

The tests for which results are set forth in Tables I and II employed a copper hearth having a bottom extending under the titanium charge with the nozzle test materials in a simple nozzle configuration disposed in a copper nozzle support.

TABLE II

| Test No. | Nozzle Material | Thickness | Hole Size | Result |
|---|---|---|---|---|
| 1 | $Al_2O_3$ | .036" | .080" | Long Cu nozzle - |
| | Copper | .125" | .089" | froze off early. |
| 2 | BN | .249" | .090" | Deep BN nozzle may |
| | Tungsten | .020" | .080" | have frozen early. |
| 3 | Tungsten | .020" | .090" | Deep tungsten-BN |
| | BN | .063" | .078" | layer composite - |
| | Tungsten | .020" | .078" | froze off on top |
| | BN | .063" | .078" | tungsten piece. |
| | Tungsten | .020" | .078" | |
| 4 | Tungsten | .020" | .078" | Froze off on top |
| | BN | .063" | .078" | plate. |
| | Tungsten | .020" | .078" | |
| 5 | Tungsten | | .089" | 163 gm. charge. |
| 6 | Tungsten | | .090" | 153 gm. charge - didn't go. |

The results of these tests show that all of the ceramics eroded or completely dissolved, when in contact with the flowing liquid titanium metal for even a short time. In contrast, the tungsten components did not show erosion. This suggested that tungsten is a good nozzle material, but the problem of initiating flow using such a nozzle material was not yet solved, this being a problem requiring proper evaluation of the heat transfer characteristics in the system.

The testing of other candidate materials followed, the results of which are shown in TABLE III.

TABLE III

| Test No. | Nozzle Material | Result |
|---|---|---|
| 1 | $Er_2O_3$ | SEVERE EROSION |
| 2 | $75Y_2O_3.25CaS$ | SEVERE EROSION |
| 3 | $Mo_3Al$ | SEVERE EROSION |
| 4 | $TiB_2$ | MODEST TO SEVERE EROSION. Cracking and reaction were obvious. Accumulation of reaction product was evident below the nozzle. |
| 5 | TiN | MODEST TO SEVERE EROSION. Cracking and interdiffusion and reaction were evident at the top of the nozzle. |
| 6 | Mo | MODEST TO SEVERE EROSION. Erosion appeared to be at least an order of magnitude faster than for tungsten. |
| 7 | $50Y_2O_3.50W$ | MODEST EROSION. Apparent cracking and interdiffusion, but attack was limited to the upper half of the nozzle. |
| 8 | TaC | MODEST EROSION. TaC appeared to have been penetrated by liquid Ti in places. There appeared to be the potential for greater reaction at longer exposure times. |
| 9 | WC | MODEST EROSION. A diffusion zone of penetration into the WC was concentrated at the top orifice corners. |

Pyrolytic graphite was tried as a nozzle material in two runs, but in each attempt freeze-off occurred early in the run. The results of the series of tests in TABLE III established that ceramic materials such as yttria ($Y_2O_3$) and erbia ($Er_2O_3$) are eroded rapidly. Combinations of $Y_2O_3$ and either $Y_2S_3$ or CaS were rapidly eroded as was cerium oxysulfide. With the exception of erbia, all of the preceding materials had previously been shown to have some resistance to molten titanium or titanium alloys and thereby were considered suitable as crucible containment.

Tantalum carbide and cemented tungsten carbide are reasonably viable nozzle materials, the latter in particular, because of its good thermal shock resistance and high heat capacity. In the case of cemented tungsten carbide, however, it would be preferred that cobalt be replaced by molybdenum or tungsten as the cementing metal.

Having discovered the excellent resistance of tungsten to erosion by flowing liquid titanium and having reassessed the system heat flow requirements for the successful utilization of bottom pouring nozzles, the improved cold hearth design schematically illustrated in the drawing emerged. The dramatic change in design to accommodate the critical parameters of liquid metal superheat and liquid metal flow rate so as to optimize the erosion resistance of the tungsten nozzle are manifest. This design of a cold hearth bottom-pour system overcomes the problem of unreliability due to freeze-off in the nozzle orifice while allowing the ejection of large quantities of liquid titanium alloy without significant contamination thereof.

Referring now to the drawing, the bottom-pouring cold hearth melting system 10 comprises hollow hearth 11, which may be water cooled (water cooling not shown) or may consist of a massive copper block to make use of the heat capacity of such a body to accomplish the cooling required. In the usual construction, as is represented in the drawing, the overall (i.e. outer configuration) shape is that of a rectangular solid with the hollow interior in the shape of a right cylinder. Although the design of hearth 11 is conventional in this regard, it is not conventional in that the hearth does not have a cooled bottom. In the place of the conventional cooled bottom portion of such a hearth, the structural component of the bottom is the diaphragm nozzle 12 supported on shoulder 13. This diaphragm nozzle 12 may be made entirely of tungsten or a suitable tungsten alloy as shown or may be composed of a central portion made of tungsten in which the nozzle orifice 14 is located supported by a surrounding load-bearing member, e.g. a ring-like disc of a different material.

The positioning of diaphragm 12 relative to hearth 11 places orifice 14 substantially at hearth-center. The bottom of the cold hearth is, therefore, no longer a heat sink as would be the case with a cooled bottom, but is effectively thermally insulating relative to wall 11. Because of this design characteristic, the titanium charge placed in hearth 11, in which melting occurs from the top down, can liquefy to greater depths than would be the case, if the charge were contained in the prior art copper hearth having a cooled bottom. With this new construction a larger volume of liquid titanium, or titanium alloy, is generated for any given power input level and the maximum superheat in the melt is increased. An additional aspect of the heat flow pattern so modified is that as the melt front approaches the bottom the nozzle diaphragm is preheated with the temperature of the central portion thereof (i.e. around orifice 14) being at a temperature close to the melting point of the metal being melted. This characteristic helps assure reliable liquid metal flow initiation.

In the use of this cold hearth system in the melting of titanium metal, pieces of the metal are dumped into hearth 11, which is located in the upper chamber 16 of a two-chamber housing having separate facilities (not shown) for drawing a vacuum in upper chamber 16 and in lower chamber 17. In addition, upper chamber 16 should have the capability for the application of inert gas pressure to the upper surface of the melt, and a lower pressure inert atmosphere to the lower chamber.

Melting is accomplished in the typical arrangement by drawing an arc between electrode 18, e.g. a thoriated-tungsten non-consumable electrode, and the metal to be melted. Other conventional melting arrangements can be used as well. The use of a plasma as the intense heat source in place of arc electrode 18 has the advantage that less turbulence is induced in the pool of liquid metal.

Once arc 19 has been struck, melting is initiated in the titanium at its upper surface and proceeds in a generally enlarging and deepening melt zone (somewhat parabolic in shape) with melt front 21 gradually moving downward to the position shown therefor at 22 as additional heat enters the metal. Most of the heat loss is radially outward into the copper wall, the transmission of heat downwardly to, and through, the diaphragm nozzle 12 being, comparatively speaking, minimal.

When the conditions are such that the melt front has acquired the general shape 22, the titanium above orifice 14 will have just reached the melting point of titanium. The rest of the titanium charge above diaphragm 12 is below the melting point (or solidus temperature, in the case of a titanium alloy) and consequently protects most of diaphragm 12 from erosion.

Diaphragm 12 preferably is covered by a thin sheet 23 of titanium before the charge of solid titanium is placed into hearth 11. To apply the same melting technique to other metal systems, a cover sheet of appropriate different composition would be used to minimize melt contamination on melt-through. Sheet 23 serves to protect orifice 14 from being blocked by the initially generated liquid metal, which would otherwise drip down in the early stages of melting. Also, cover sheet 23 serves to thermally isolate diaphragm 12 from the first of the liquid titanium to reach the bottom of the hearth by its own presence and by the presence of a gas layer (emphasized in thickness in the drawing) between elements 23 and 12. As initially generated liquid titanium solidifies at the bottom, the solid skull 24 that forms acts as the primary thermal barrier to premature exposure of diaphragm 12 to the temperatures prevailing in the liquified zone of the titanium metal charge.

The thickness of the protective sheet metal stopper 23 is kept as small as feasible in order to avoid altering the composition of the charge metal as sheet 23 melts and becomes part of the overall composition. Although a pure titanium metal, or congruently melting alloy would seem to be preferred for the stopper sheet 23, its composition can be altered to suit the requirements of the alloy composition finally discharged.

Thus, when liquid titanium comes in contact with titanium sheet 23 for a long enough period of time, the sheet melts and allows liquid titanium to reach orifice 14 and flow therethrough under inert gas pressure in upper chamber 16. The discharge time will typically be about three minutes in laboratory size equipment and is expected to run considerably longer in a commercial system.

During the extent of the liquid discharge period, as the level of the liquid titanium drops, arc 19 continues to heat the remaining titanium liquid. At the same time the diameter of contact of the molten titanium with diaphragm 12 gradually enlarges. In those runs in which no additional molten titanium is added (as from a separate vessel, not shown, located in chamber 16; in this case, hearth 11 would function as a pouring tundish in like manner to conventional commercial metal powder atomization facilities), as the level of the liquid titanium in hearth 11 drops during the discharge, the temperature of the molten titanium contacting the tungsten of diaphragm 12 increases with its increasing superheat. Direct, or very nearly direct, contact between the arc plasma and the nozzle orifice would result in accelerated erosion of the nozzle. To avoid the occurrence of such a condition, a minimum depth of molten titanium is retained in the hearth. In the apparatus described, this minimum depth should be in the range of from about ½ to 1 inch. If a different melting arrangement is employed, the minimum liquid metal depth required may be different, but routinely determinable.

The need for maintaining a minimum liquid metal depth is illustrated in TABLE IV utilizing a diaphragm nozzle sheet 0.020 inch thick and having an orifice diameter of 0.030 inch.

TABLE IV

| RUN NUMBER | LIQUID TITANIUM EJECTED (LB) | FINAL MELT DEPT (INCH) | FINAL ORIFICE DIAMETER (INCH) | DIAMETER OF REGION OF WETTING (INCH) | TOTAL RADIAL EROSION (INCH) |
|---|---|---|---|---|---|
| 1 | 0.22 | 0.68 | 0.034 | 0.6 | .002 |
| 2 | 1.15 | 0.84 | 0.040 ± .003 | | .005(approx) |
| 3 | 1.21 | 0.78 | 0.045 | 0.24 | .0075 |
| 4 | 0.53 | 0.030 | 0.065 | 1.0 | .0175 |
| 5 | 2.54 | 0.60 | 0.044 | | .007 |

The initiation of liquid metal flow is reliable and predictable when using the tungsten diaphragm nozzle configuration shown. Heat from skull 24 above diaphragm 12 preheats the diaphragm to a temperature just below that of the temperature of the liquid titanium. Because of this, the first liquid which comes through orifice 14 is subject to only modest heat extraction thereby making freeze-off unlikely. As ejection of the liquid metal proceeds, the temperature of diaphragm 12 in the region of orifice 14 should be virtually the same temperature as the temperature of the liquid metal passing therethrough. The radially outer portion of the diaphragm is kept near the temperature of titanium skull 24 with which it is in thermal contact. The gas layer present between member 23 and member 12 is an effective component of the thermally insulating bottom of the hearth. Thus, the titanium charge moderates the temperature of diaphragm 12 even when superheated liquid metal is in transit through orifice 14. Since the thermal diffusivity of the tungsten diaphragm is higher than that of the titanium skull, heat should be conducted away from the high temperature central region of the diaphragm near orifice 14 to the cooler parts thereof which are, in turn, kept at a temperature close to the melting point of the alloy by the alloy skull.

EXAMPLE

Cold hearth arc melting of commercial purity titanium was performed in a massive copper hearth of approximate outside dimensions 9" wide × 10" long × 5" deep with a 5" diameter cylindrical hollow core in the center of the hearth to contain the melt. In the case of runs 1–4, the bottom of the copper hearth was tapered inward closing off some of the bottom of the hollow core. A centrally located two inch outer diameter tungsten diaphragm nozzle was supported on the tapered portion at the bottom of the hearth while for run 5 the taper was absent and a 4⅞ inch diameter tungsten diaphragm nozzle was accommodated. A summary of the results of runs 1–5 is presented in TABLE V.

TABLE V

| Run Number | Hearth Dia (in.) | Diaphragm Dia (in.) | Ti Charge (lb.) | Ejection Press. (psi.) | Liquid Ti Ejected (lb.) | Final Melt Depth (in.) | Initial Orifice Diameter (in.) | Final Orifice Diameter (in.) |
|---|---|---|---|---|---|---|---|---|
| 1 | 5 | 2 | 1.0 | 3 | 0.22 | 0.68 | 0.030 | 0.034 |
| 2 | 5 | 2 | 4.8 | — | 0 | — | — | — |
| 3 | 5 | 2 | 3.4 | 9 | 1.15 | 0.84 | 0.030 | 0.040 |
| 4 | 5 | 2 | 3.4 | 8 | 1.21 | 0.78 | 0.030 | 0.045 |
| 5 | 5 | 4⅞ | 6.0 | 12 | 2.54 | 0.60 | 0.030 | 0.044 |

The hearth configuration described for runs 1–4 has been useful for melting titanium charges up to 3.4 lbs. in size. Charges larger than this could not be melted to the bottom of the hearth because of the extraction of heat into the hearth region at the bottom surrounding the diaphragm. Analysis of run 2 showed that for a charge of about 5 lbs. the total charge depth was about 1½ inches, the liquid depth over the diaphragm was only 1.2 inch and the melt depth over the tapered part of the copper hearth was only 0.65 inch. Liquid metal ejection did not occur, because melting did not penetrate to the bottom of the charge. The arc melting conditions for run 2 were 1900 ampere arc current at 25 volt arc voltage. Total applied power was 48 kilowatts.

When the 2 inch diaphragm hearth configuration was replaced by the 4⅞ inch diaphragm hearth configuration it was easy to melt a 6 lb. charge all the way to the bottom and eject about 2.5 lbs. of liquid metal. Liquid left orifice 14 in a steady stream for a period of more than 40 seconds. Both conventional and high speed video recording of the emerging stream showed that the liquid stream was continuous and straight. Power was terminated roughly 40 seconds after the pouring began and liquid continued to flow for approximately two seconds after the run was terminated leaving a melt depth of 0.6 inch to provide the requisite protection for the tungsten diaphragm. There was little erosion of the tungsten diaphragm nozzle during this run. After the ejection of 2.5 lbs. of liquid titanium, erosion of the nozzle was only 0.007 inch radially. Given the total run time of more than 40 seconds, the erosion rate averaged only 0.0008 inch/sec.

The pressure below the nozzle diaphragm was in the range of −15 to −25 in. Hg argon gas for all runs. The melting chamber was pressurized with argon gas to pressures of 2–12 psi higher than the lower chamber pressure to produce the desired differential pressure across nozzle 14 to accommodate liquid metal ejection. Differential pressures in the range of 3–8 psi have been found to produce the most consistent liquid stream conditions. Lower ejection pressures sometimes result in steady stream conditions (as was the case for run 1). However, occasionally, differential pressures of the magnitude of 2 psi have resulted in an unsteady series of blobs of metal falling from the nozzle aperture.

With the cold hearth construction described herein, melting and liquid ejection can be reliably produced and, the ejected liquid metal has been deposited on a melt spinning wheel for the successful production of semi-continuous rapidly solidified metal ribbon. Also, in a two-part diaphragm (not shown) the radially outward material could be fabricated from a heat resisting but erosion-prone material such as graphite.

Low levels of tungsten pickup should be benign in titanium alloys, provided that the tungsten is not distributed in large pieces. To evaluate the uniformity of tungsten erosion by flowing liquid titanium and determine whether nozzle erosion by liquid titanium can lead to large tungsten inclusions, tungsten nozzles were examined after erosion, particularly those exposed to more severe erosion conditions because of exposure to the arc plasma. When examined by scanning electron microscopy, it was determined that attack by the liquid titanium occurred at the grain boundaries of the tungsten. Such grain boundary attack does not appear to produce deep local penetration which could lead to removal of large groups of grains, but rather displays a uniform attacking of all grain boundaries. This would be indicative of individual grain fall-out for this type of attack rather than the release of larger pieces of the nozzle. In some cases, where erosion proceeded to a greater degree, grooves developed in the rim of the orifice. Even in this mode of local attack the erosion appears to be predominantly uniform grain boundary erosion. There appears to be some potential for multiple-grain cluster fall-out where the extent of groove formation due to liquid erosion is great.

In those applications in which it is important to have highly directionalized flow of the liquid metal leaving the nozzle orifice, the orifice can comprise a tubular sleeve (not shown) inserted in a hole through the diaphragm to provide a longer (i.e. longer than the thickness of the diaphragm) liquid discharge path.

The unusual capability of the cold-hearth configuration to successfully accommodate the bottom pouring of liquid titanium should not be construed as a limitation on the use of this apparatus. On the contrary, a distinct advantage is seen in the use of this apparatus for the bottom pouring of nickel-based alloys. The molten liquid alloy discharged is expected to be completely free of ceramic content in contrast to the processing of such alloys at present.

What is claimed is:

1. A bottom-pour cold hearth melting system comprising an open-top container, a downwardly directed intense heat source mounted thereover, an outer side wall of said container being made of high thermal conductivity material and an outer bottom wall constituting a diaphragm nozzle and having a centrally-located orifice extending through the thickness thereof whereby during use a charge of solid metal placed in said container can be heated at the top of the charge to produce a continually deepening centrally-located molten pool of said metal held within an inner solidified mass of said metal, said solidified mass being located between said pool and said outer side walls and bottom diaphragm wall until said deepening pool reaches said diaphragm orifice and is discharged therethrough, at least the inner central portion of the structure of said bottom diaphragm wall being a refractory metal diaphragm nozzle in which a nozzle orifice is located, said metal diaphragm nozzle having an effective lateral diameter of at least about 1.5 inches with the ratio of effective lateral diameter to thickness being at least about 10 to 1.

2. The improvement of claim 1 wherein the material of said metal diaphragm is selected from the group consisting of tungsten and alloys containing tungsten and having a melting point at least as high as about 3000° C.

3. The improvement of claim 2 wherein the orifice diameter is in the range of from about 0.20 to about 0.15 inch and the outer effective diameter is at least about 5 inches.

4. The improvement of claim 2 wherein the thickness of the metal diaphragm is about 0.020 inch.

5. The improvement of claim 1 wherein the ratio of the outer effective diameter of the diaphragm to the diameter of the orifice is at least about 6:1.

6. The improvement of claim 1 wherein the metal sheet is covered with a thin imperforate solid layer made of the metal or an alloy thereof.

7. The improvement as recited in claim 1 wherein the intense heat source is an arc electrode.

8. The improvement as recited in claim 1 wherein the intense heat source generates a plasma.

9. The method of bottom-pour cold hearth melting of a metal comprising providing a mass of solid metal, placing said metal in a container having the side walls thereof made of high thermal conductivity material and a bottom diaphragm wall, subjecting the mass of metal to melting at the top center of said mass to produce a continually deepening pool of the metal contained in a solidified mass of the metal and, when the depth of said pool has been extended to reach said bottom diaphragm wall, molten metal from said pool is discharged from said container under the application of pressure by an inert gas through a centrally-located orifice in said bottom diaphragm wall, using as at least the central portion of the structure of said bottom diaphragm wall of refractory metal nozzle containing said orifice, said metal diaphragm nozzle having an outer effective diameter of at least about 1.5 inches, and stopping discharge of the molten metal by the time the depth of said pool over said metal diaphragm has been reduced to no less than one-half inch.

10. The improvement of claim 9 wherein the material of the metal sheet is tungsten or an alloy containing tungsten and having a melting point at least as high as about 3000° C.

11. The improvement of claim 9 wherein the mass of metal subjected to melting is titanium or a titanium alloy.

12. The improvement of claim 9 wherein the mass of metal subjected to melting is a nickel-base alloy.

13. The improvement of claim 9 wherein the gas pressure applied to discharge the molten metal is about 2 to about 12 psi greater than the pressure below the orifice.

14. A bottom-pour cold hearth melting system comprising an open-top container having a downwardly directed intense heat source mounted thereover, the side walls of said container being made of high thermal conductivity material and the bottom wall being a diaphragm nozzle having a centrally-located orifice extending through the thickness thereof whereby during use a charge of solid metal placed in said container can be heated at the top of the charge to produce a continually deepening centrally-located molten pool of said metal held within a solidified mass of said metal, said solidified mass being located between said pool and said side walls and said bottom diaphragm wall until said deepening pool reaches said orifice of said diaphragm wall and is discharged therethrough, at least the central portion of the structure of said bottom diaphragm wall is a diaphragm nozzle in which said orifice is located, said metal diaphragm being made of a material selected from the group consisting of tungsten, an alloy containing tungsten and having a melting point of at least about 3000° C., cemented tungsten carbide and tantalum carbide.

15. The improvement of claim 14 wherein the cementing agent for the cemented tungsten carbide is tungsten or molybdenum.

* * * * *